United States Patent [19]

Peterson

[11] 4,206,689

[45] Jun. 10, 1980

[54] PRIORITY SYSTEM

[75] Inventor: Wayne A. Peterson, Washington, Ill.

[73] Assignee: Caterpillar Tractor Co., Peoria, Ill.

[21] Appl. No.: 826,575

[22] Filed: Aug. 22, 1977

[51] Int. Cl.[2] ..... F15B 11/20; F15B 13/07

[52] U.S. Cl. ..... 91/516; 91/517; 91/518; 91/520

[58] Field of Search ..... 91/412, 6, 451, 513, 91/532, 516, 518, 514, 517, 520; 137/596.13, 118, 596.12; 60/484

[56] References Cited

U.S. PATENT DOCUMENTS

| | | | |
|---|---|---|---|
| 3,099,284 | 7/1963 | Thrap et al. | 137/118 X |
| 3,373,763 | 3/1968 | Smilges et al. | 137/489 |
| 3,463,187 | 8/1969 | Rue | 91/451 X |
| 3,700,396 | 10/1972 | Adams | 91/449 |
| 3,811,363 | 5/1974 | Cryder | 91/412 |
| 4,030,522 | 6/1977 | Heiser | 137/596.13 |

*Primary Examiner*—Irwin C. Cohen
*Attorney, Agent, or Firm*—John W. Grant

[57] ABSTRACT

A priority system has a valve assembly which has an inlet, first and second outlets, and apparatus for controllably limiting fluid pressure at the first outlet to a preselected maximum value by controllably communicating the second outlet with the inlet. The priority system has a fluid reservoir, a work element and control apparatus connected to the work element, second outlet and reservoir which receives fluid from the second outlet and passes the fluid to the fluid reservoir or work element.

9 Claims, 1 Drawing Figure

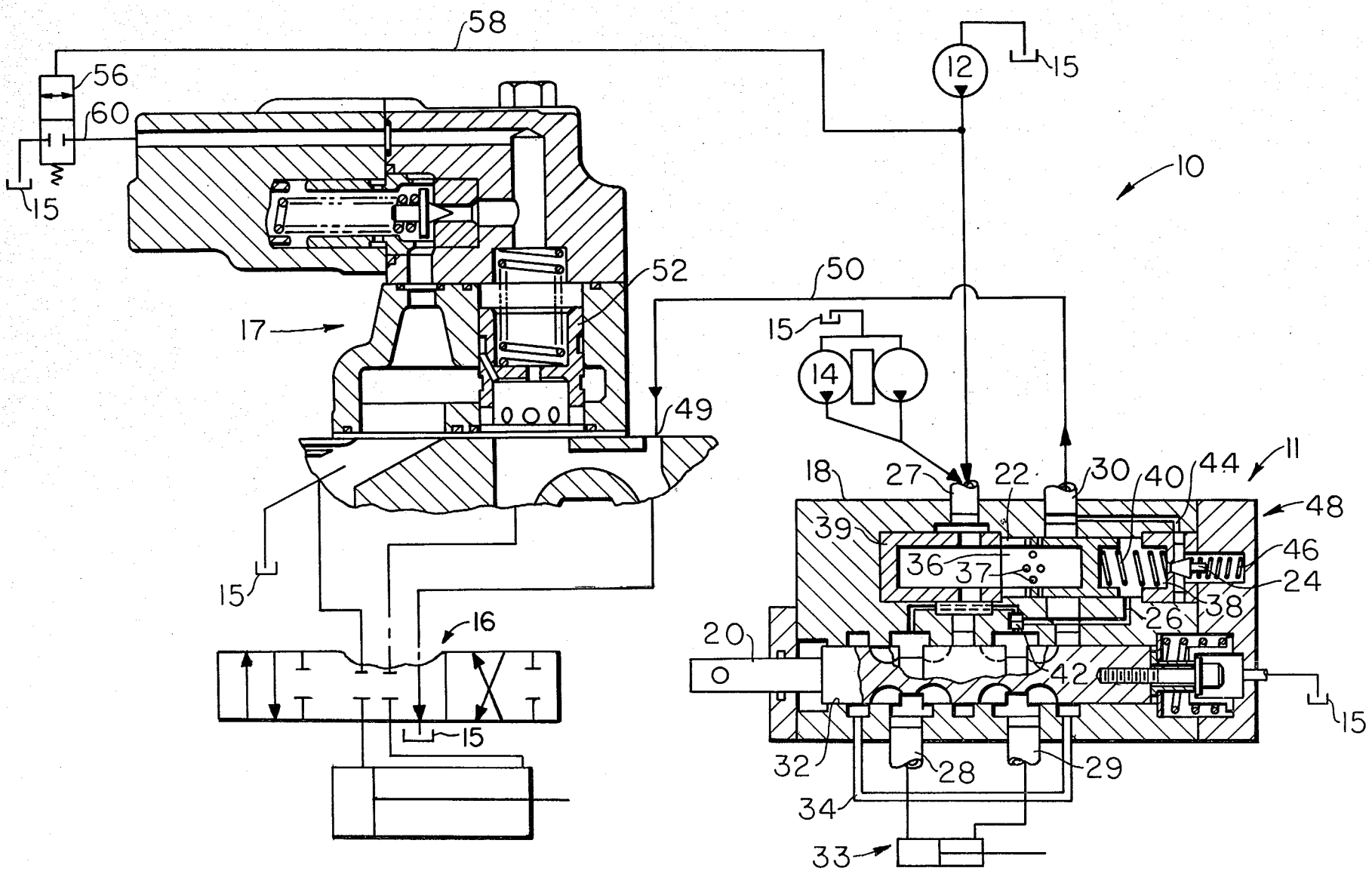
10
11
12
14
15
16
17
18
20
22
24
26
27
28
29
30
32
33
34
36
37
38
39
40
42
44
46
48
49
50
52
56
58
60

PRIORITY SYSTEM

BACKGROUND OF THE INVENTION

Hydraulic equipment, such as a tractor-scraper for example, sometimes uses a single pump to supply pressurized fluid for steering and operating the implements such as, for example, an apron and ejector. The single pump is more economical than separate pumps for steering and implements. It is desirable to always have the pressurized fluid available for steering with priority over the implements.

SUMMARY OF THE INVENTION

The present invention is directed to overcoming one or more of the problems as set forth above.

According to the present invention, a priority system comprises a valve assembly having an inlet, at least first and second outlets and pressure relief means for controllably limiting fluid pressure at the first outlet to a preselected maximum value by controllably communicating the second outlet with the inlet. Control means is connected to a work element, a fluid reservoir and the second outlet for receiving fluid from the second outlet and controllably passing the fluid to one of the fluid reservoir and work element.

BRIEF DESCRIPTION OF THE DRAWING

The drawing is a diagrammatic view of the present invention.

DETAILED DESCRIPTION

Referring to the drawing, a priority system 10 includes a valve assembly 11, preferably a steering valve assembly, which is connected to first and second sources of pressurized fluid 12, 14, preferably engine and ground driven pumps and to a fluid reservoir 15. A work element 16, preferably an implement control valve, is controlled by control means 17 connected to the work element 16, steering valve assembly 11 and reservoir 15. The control means 17 receives fluid from the steering valve assembly 11 and controllably, selectively passes the fluid to one of the fluid reservoir 15 and work element 16.

The steering valve assembly 11 includes a housing 18, first and second spools, preferably a steering spool 20, and a dump spool 22, a pilot poppet 24 and a passageway 26 which connects the steering spool 20 with the dump spool 22 and pilot poppet 24.

The housing 18 includes an inlet 27, first and second steering outlets 28, 29, a series outlet 30, and a bore 32. The steering spool 20 is positioned in the bore 32 and is movable between a first position at which the inlet 27 is in fluid communication with the passageway 26 and one of the steering outlets 28, 29 and a second position at which the inlet 27 is blocked from fluid communication with the passageway 26 and the steering outlets 28, 29. Pressurized fluid in the steering outlets 28, 29 is used to energize a vehicle steering assembly 33 which uses fluid up to a preselected maximum differential pressure between outlets 28 and 29.

A passageway 34 connects the steering assembly 33 and series outlet 30 and receives the return flow from the steering assembly 33. Pressure created by the implement control valve 16 is felt at the steering assembly 33 as back pressure. When the steering spool 20 is shifted to connect the pump 12 to the steering outlet 28, then outlet 29 is connected to the series outlet 30 and passageway 34. When the spool 20 is shifted to connect the pump 12 to outlet 29, then outlet 28 is connected to the series outlet 30 through the passageway 34.

The dump spool 22 is positioned in the housing 18 and defines a first upstream chamber 36 which has openings 37 for fluid communication with the series outlet 30 and a second downstream chamber 38. A slotted spacer 39 is preferably positioned in the housing 18 on either side of the dump spool 22. The first chamber 36 is in fluid communication with the inlet 27 and steering spool 22 and the second chamber 38 is in fluid communication with the passageway 26. The dump spool 22 is movable between a first position at which the inlet 27 is blocked from fluid communication with the series outlet 30 and a second position at which the inlet 27 and series outlet 30 are in fluid communication.

A biasing means 40, preferably a spring, urges the dump spool 22 towards the first position. The dump spool 22 is movable from the first position towards the second position in response to the force caused by fluid pressure in the first chamber 36 exceeding the force caused by fluid pressure in the second chamber 38 and the spring 40.

The passageway 26 connects the steering outlets 28, 29 to the second chamber 38 and is preferably formed in the housing 18 but can be external to the housing 18. A resolver valve 42 which is positioned in the passageway 26 connects the steering outlets 28, 29 to the second chamber 36 and prevents the flow of fluid from one outlet to the other through the passageway 26.

A pathway 44 connects the second chamber 38 to the series outlet 30 and is preferably formed in the housing 18 but can be generally external the housing 18. The pilot relief poppet 24 is positioned in the pathway 44 and is movable between a first position at which the second chamber 38 and series outlet 30 are blocked from fluid communication through the pathway 44 and a second position at which the second chamber 38 and series outlet 30 are in fluid communication through the pathway 44.

A biasing means 46, preferably a spring, urges the pilot poppet 24 towards the first position. The pilot poppet 24 is movable from the first position towards the second position in response to the force caused by fluid pressure in the second chamber 38 exceeding the force caused by back pressure in the pathway 44 and the spring 46 which is set at the maximum differential pressure required between the steering outlets 28, 29.

The dump spool 22 receives fluid pressure upstream in the first chamber 36 through the inlet 27 and receives downstream fluid pressure in the second chamber 38 through the passageway 26.

The spools 20, 22, chambers 36, 38, pathways 26, 44 and pilot poppet 24 comprises a pressure relief means 48 for controllably limiting fluid pressure at the steering outlets 28, 29 to a preselected maximum value by controllably communicating the second outlet 30 with the inlet 27.

The engine and ground driven pumps 12, 14 are connected to the inlet 27 of the steering valve assembly 11 and an inlet 49 of the implement control valve 16 is connected to the series outlet 30 by conduit 50. The implement control valve 16 is controlled by the control means 17 which preferably includes a pilot operated relief valve 52 which opens to vent fluid to the reservoir 15 at a preselected pressure greater than the pressure required to move the pilot poppet 24 from the first position to the second position. The implement control valve 16 and the relief valve 52 offer resistance to fluid flow and insure that pressure exists in the conduit 50 and series outlet 30 representative of working conditions.

A modulating valve 56 is preferably connected to the inlet 27 by conduit 58 and controllably vents fluid to the reservoir 15 by way of the relief valve 52 when fluid pressure from the pumps 12, 14 exceeds a preselected value which is greater than the pressure at which the pilot operated relief valve 52 vents fluid to the reservoir 15. The pilot relief valve 52 preferably passes fluid through conduit 60 to the modulating valve 56.

For example, where the maximum desired operating pressure of the pump 12 is 2500 psi and the maximum differential pressure between the steering outlets 28, 29 is 1725 psi the valve 56 would open at pump pressures above 2500 psi, and the poppet spring 46 would be set to exert approximately 1725 psi on the poppet 24 to urge the poppet toward the first position. Fluid would flow to the steering outlet 29 and to the second chamber 38 exerting a force on the poppet 24 to urge it toward the second position. The dump spool 22 would move towards the second position and fluid would flow out the series outlet 30 and through the pathway 44 to urge the poppet towards the first position. The steering outlet pressure would be maintained at 1725 psi above the series outlet pressure and the series outlet pressure would increase in proportion to the load encountered by the control valve 16. The pressure on the backside of the poppet 24 would be the same as the pressure in outlet 30 which moves the poppet 24 toward the first position and maintains steering outlet pressure at 1725 psi above the series outlet pressure. Due to modulating valve 56, the maximum operating pressure of the pump 12 would be limited to 2500 psi. Thus when steering pressure is 1725 psi, then implement pressure can only be 775 psi. A decrease in steering outlet pressure would allow the implement pressure to increase proportionately.

Any back pressure in the implement control valve 16 is felt at the steering assembly 33. If both the steering assembly 33 and implement valve 16 demand high pressure, the outlet 28 may feel 2500 psi and 775 psi at outlet 29 which is the differential pressure limited by the poppet spring 46.

The relief valve 52 is set to open at 2000 psi, for example, and opens when maximum pressure is not required at the steering outlets 28, 29. The modulating valve 56 opens at 2500 psi, for example, and vents fluid through the relief valve 52.

In operation, an operator shifts the steering spool 20 to the first position which forms a fluid passageway from the inlet 27, through the first chamber 36, one of the steering outlets 28, 29, and passageway 26 to the second chamber 38. Force caused by the spring 40 and fluid in the second chamber 38 overcomes force caused by fluid pressure in the first chamber 36 and urges the dump spool 22 towards the first position. When the preselected maximum pressure in the steering outlet 29 is reached, the pilot poppet 24 moves towards the second position and fluid flows from the second chamber 38 to the series outlet 30 via passage 44 causing a pressure drop which urges the dump spool 22 towards the second position. Fluid now flows to the steering outlet 29, the series outlet 30 and the implement control valve 16. Fluid momentarily flows from the series outlet 30 through the pathway 44 to the backside of the poppet 24 at a pressure controlled by the implement control valve 16. The force now urging the poppet 24 towards the first position is the force caused by the fluid and the spring 46 which maintains fluid pressure to the series outlet 30 substantially at pump pressure less steering outlet pressure. The poppet 24 only remains in the second position for a length of time sufficient for fluid pressure above the then required steering outlet pressure to be relieved.

When the operator shifts the spool 20 to the second position, fluid flows into the first chamber 36. When the pressure in the first chamber 36 exceeds pressure in the second chamber 38 created by the spring 40, fluid flows to the series outlet 30. In the second position, fluid flow to the steering outlets 28, 29 is blocked.

Thus, by shifting the steering spool 20 to effect steering, priority of fluid flow is automatically given to the steering assembly 33 over implement control valve 16.

Other aspects, objects and advantages will become apparent from a study of the specification drawing and appended claims.

The embodiments of the invention in which an exclusive property or privilege is claimed are defined as follows:

1. In a priority system for series type hydraulic circuits having a source of fluid, a fluid jack, a first control valve connected to the source of fluid and to the fluid jack, a pressure responsive work element means, a second control valve serially connected to an outlet of the first valve and to the work element means, a valve spool within the first valve and movable between a first position at which the source of fluid is in communication with one end of the fluid jack and the other end of the fluid jack is in communication with the outlet of the first valve, and a second position at which the source of fluid is blocked from the fluid jack, a dump spool in the first valve and movable between a first position at which the source of fluid is blocked from fluid communication with the outlet and a second position at which the source of fluid is in communication with the outlet, a chamber in the first valve at one end of the dump spool, passage means connecting the source of fluid to the chamber at the first position of the valve spool to bias said dump spool toward said first position, the improvement comprising:

first means for relieving the fluid pressure in the chamber in response to the pressure in the chamber exceeding a preselected pressure;

second means connecting the outlet of the first valve with said fluid pressure relieving means for increasing the preselected pressure at which the fluid pressure in the chamber is relieved proportional to the fluid pressure in the outlet; and third means connected to the source of fluid and to the outlet for relieving fluid pressure in the outlet in response to the fluid pressure of the source of fluid exceeding a second preselected pressure.

2. The priority system of claim 1 wherein the first means includes another chamber in the first valve, a relief poppet positioned within the other chamber and movable between a first position at which the first chamber is blocked from communication with the other chamber and a second position at which the first chamber is in communication with the other chamber, and a spring resiliently urging the relief poppet to the first position.

3. The priority system of claim 2 wherein the second means connecting the outlet of the first valve with the first means includes a passageway connecting the other chamber with the outlet.

4. The priority system of claim 3 wherein said relief poppet has first and second sides, the first side being in communication with the first chamber and the second side being in communication with the other chamber.

5. The priority system of claim 4 wherein said third means includes a relief valve in fluid communication with the outlet and being of a construction sufficient for opening in response to the fluid pressure in the outlet exceeding a third preselected value.

6. The priority system of claim 5 wherein said relief valve has a control chamber, the third means including a pilot actuated modulating valve connected to the control chamber and movable between a first position at which communication from the control chamber is blocked and a second position at which the control chamber is vented, the pilot operated modulating valve being connected to the source of fluid and movable to the second position in response to the fluid pressure at the source of fluid exceeding the second preselected pressure greater than the opening pressure of the relief valve.

7. The priority system of claim 1 wherein said third means includes a relief valve in fluid communication with the outlet and being of a construction sufficient for opening in response to the fluid pressure in the outlet exceeding a third preselected value, said relief valve having a control chamber, and a pilot actuated modulating valve connected to the control chamber and movable between a first position at which communication from the control chamber is blocked and a second position at which the control chamber is vented, the pilot operated modulating valve being connected to the source of fluid and movable to the second position in response to the fluid pressure at the source of fluid exceeding the second preselected pressure greater than the opening pressure of the relief valve.

8. The priority system of claim 7 wherein the first means includes another chamber in the first valve, a relief poppet positioned within the other chamber and movable between a first position at which the first chamber is blocked from communication with the other chamber and a second position at which the first chamber is in communication with the other chamber, and a spring resiliently urging the relief poppet to the first position.

9. The priority system of claim 8 wherein the second means connecting the outlet of the first valve with the first means includes a passageway connecting the other chamber with the outlet.

* * * * *